United States Patent [19]

Madray

[11] Patent Number: 4,756,133

[45] Date of Patent: Jul. 12, 1988

[54] METHOD AND APPARATUS FOR CONSTRUCTING BUILDING STRUCTURES

[76] Inventor: Herbert R. Madray, P.O. Box 712, Okeechobee, Fla. 33472

[21] Appl. No.: 796,915

[22] Filed: Nov. 12, 1985

Related U.S. Application Data

[63] Continuation-in-part of Ser. No. 709,317, Jan. 22, 1985, Pat. No. 4,697,393, which is a continuation-in-part of Ser. No. 496,960, May 23, 1983, Pat. No. 4,551,957.

[51] Int. Cl.[4] ..... E02D 27/00

[52] U.S. Cl. ..... 52/293; 52/90; 52/127.2; 52/127.8

[58] Field of Search ..... 52/90, 92, 127.2, 127.6, 52/127.8, 274, 276, 278, 292, 293, 294, 299, 741, 747

[56] References Cited

U.S. PATENT DOCUMENTS

| | | | |
|---|---|---|---|
| 1,850,118 | 3/1932 | Meyers . | |
| 1,959,880 | 5/1934 | Sims . | |
| 2,067,403 | 1/1937 | Lea . | |
| 2,574,074 | 11/1951 | Vogel . | |
| 2,801,716 | 8/1957 | Colby | 52/299 |
| 4,011,697 | 3/1977 | Fedolfi . | |
| 4,142,335 | 3/1979 | Andrade . | |
| 4,205,497 | 6/1980 | Schirm . | |
| 4,263,762 | 4/1981 | Reed | 52/293 |
| 4,275,534 | 6/1981 | Porter . | |
| 4,356,675 | 11/1982 | Reicherts . | |
| 4,365,453 | 12/1982 | Lowe . | |

FOREIGN PATENT DOCUMENTS

| | | |
|---|---|---|
| 2902322 | 7/1980 | Fed. Rep. of Germany . |
| 1229153 | 9/1960 | France . |
| 2340433 | 2/1977 | France . |
| 783403 | 9/1957 | United Kingdom . |
| 1025751 | 4/1966 | United Kingdom . |

*Primary Examiner*—J. Karl Bell

*Attorney, Agent, or Firm*—Steele, Gould & Fried

[57] ABSTRACT

A method for constructing building structures and the like includes erecting a footing frame, levelling the frame and any further building structure attached to the footing frame, and then pouring a footing using the framing effect of the footing frame. A footing frame apparatus for this purpose has form structure, stud track structure affixed to the form structure allowing the attachment of additional building structure to the form structure, and bracing structure to add strength and rigidity to the apparatus.

20 Claims, 5 Drawing Sheets

METHOD AND APPARATUS FOR CONSTRUCTING BUILDING STRUCTURES

CROSS REFERENCE TO RELATED APPLICATIONS

This application is a continuation-in-part of co-pending U.S. Patent application Ser. No. 709,317, filed Jan. 22, 1985 now U.S. Pat. No. 4,697,393, which is the U.S. national phase application of PCT application Ser. No. PCT/US 84/00782 filed May 22, 1984. Application Serial No. 709,317 is a continuation-in-part of co-pending U.S. Patent application Ser. No. 496,960, filed May 23, 1983, now U.S. Pat. No. 4,551,957.

BACKGROUND OF THE INVENTION

1. Field of the Invention

This invention relates generally to a method and apparatus for constructing building structures and the like, and more particularly to a method of using a footing frame apparatus for constructing a building.

2. Description of the Prior Art

It is known in the building construction art that a building structure must have an adequate footing to ensure that the structure remains stable and level throughout the life of the building structure. The footing is usually constructed by first preparing the site by clearing and leveling the ground and then digging a trench to form a mold for the footing and slab. A form, usually made of wood, is constructed to outline the desired shape and dimensions of the footing. The footing material is poured, usually with cement or concrete, and after it has set, the wood form is removed.

It has long been the practice of the building construction industry to lay a level footing before erecting other building structure. Working from the "ground up" is consistent with present day construction techniques. Buildings are usually constructed on site in a piece-wise manner with the first pieces being connected to the footing and with each new addition to the structure being affixed to those already in place. The firm foundation provided by the footing ties the building structure together as pieces are added and bears much of the stress during construction that might otherwise result in undue stress on individual pieces and joints.

The standard method of construction suffers from a number of drawbacks. It is time consuming to construct the forms, pour the footing, then remove the forms once the footing has set. The footing so produced is not easily tied to additional building structure, requiring further manpower and cost. In adverse conditions it is sometimes desirable to construct the building remote from its final installation site or in the shortest time possible at the installation site. Such conditions can render conventional building techniques useless.

It would be desirable to provide a method and apparatus for constructing a building structure which can substantially reduce the cost of construction of the building. It would also be desirable to provide a method and apparatus for constructing a building structure which can be practiced to provide building structures in remote locations or under adverse conditions. It would also be desirable if the method and apparatus could be practiced on any number of building designs and dimensions. It would be beneficial if the method and apparatus could be practiced by workmen without a great deal of specialized skills.

SUMMARY OF THE INVENTION

It is an object of the present invention to provide a method and apparatus for reducing the cost of constructing a building.

It is another object of the invention to provide a method and apparatus for constructing a building which can be utilized for constructing buildings of a variety of different designs and dimensions.

It is yet another object of the invention to provide a method and apparatus which can be utilized to provide building structures at reduced costs.

It is still another object of the present invention to provide a method and apparatus for constructing a building which can be constructed by workmen not having a great deal of specialized skills.

These and other objects are accomplished by a method and apparatus for constructing building structures and the like in which a footing frame is erected in the design and dimensions of the desired footing. The footing frame is preferably leveled by suitable leveling means. Further building structure is attached to the footing frame. The footing is then constructed by using the framing effect of the footing frame after attachment to the building structure.

A footing frame apparatus is provided that is particularly well suited for practice of the method. The apparatus includes form structure adapted to confine a fluid footing mixture to a desired shape. Structure preferably affixed to the form structure allows attachment of additional building structure to the form structure.

The form structure preferably comprises a channel member of substantially squared-off C-shaped cross section. The structure for attaching additional building structure to the form structure is preferably a stud track member having an upwardly opening channel member of substantially U-shaped cross section that is adapted to receive the ends of a plurality of wall studs. The stud track member preferably has a series of apertures which align with apertures in the studs to permit attachment of the studs to the footing frame in a quick and efficient manner and without the necessity of drilling holes.

BRIEF DESCRIPTION OF THE DRAWINGS

There are shown in the drawings embodiments which are presently preferred it being understood, however, that the invention is not limited to the precise arrangements and instrumentalities shown.

DETAILED DESCRIPTION OF THE PREFERRED EMBODIMENTS

Figure 1:
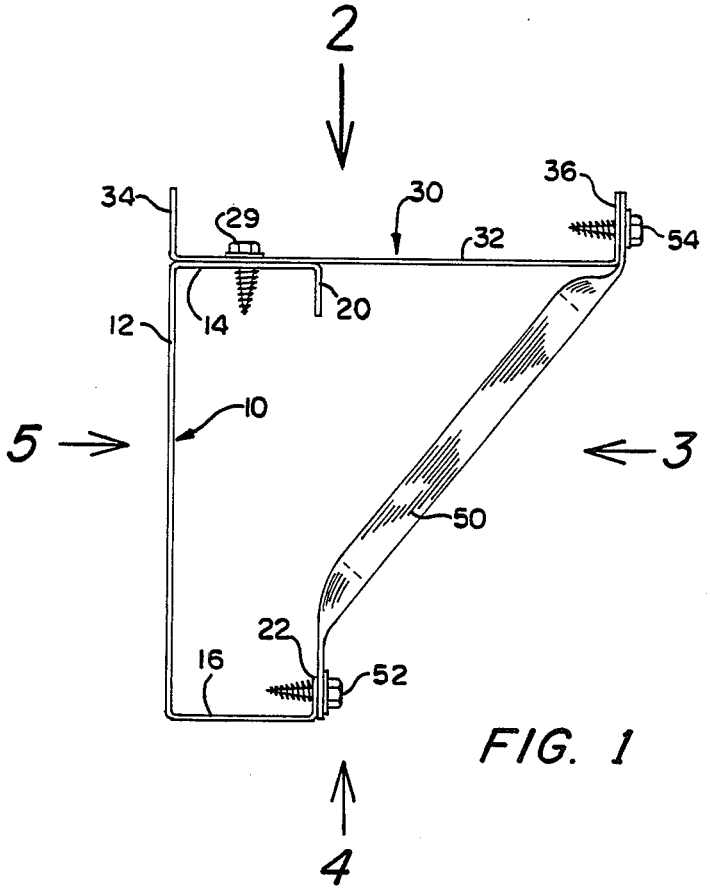
FIG. 1 is a cross sectional view of a footing frame according to the present invention.
Figure 2:
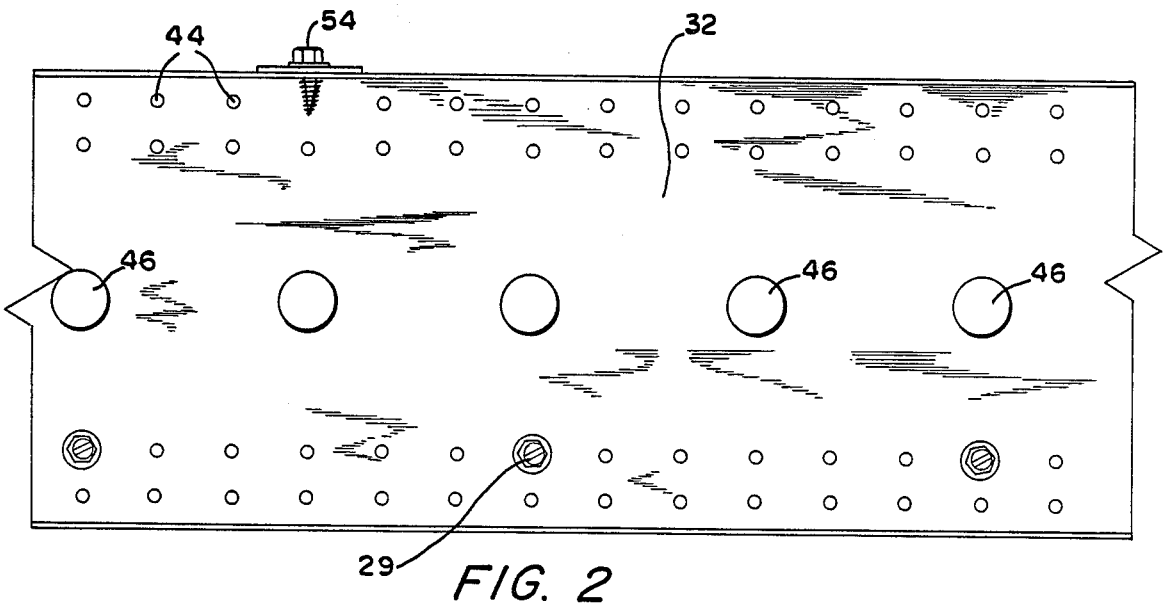
FIG. 2 is a plan view as indicated by the arrow in FIG. 1.
Figure 3:
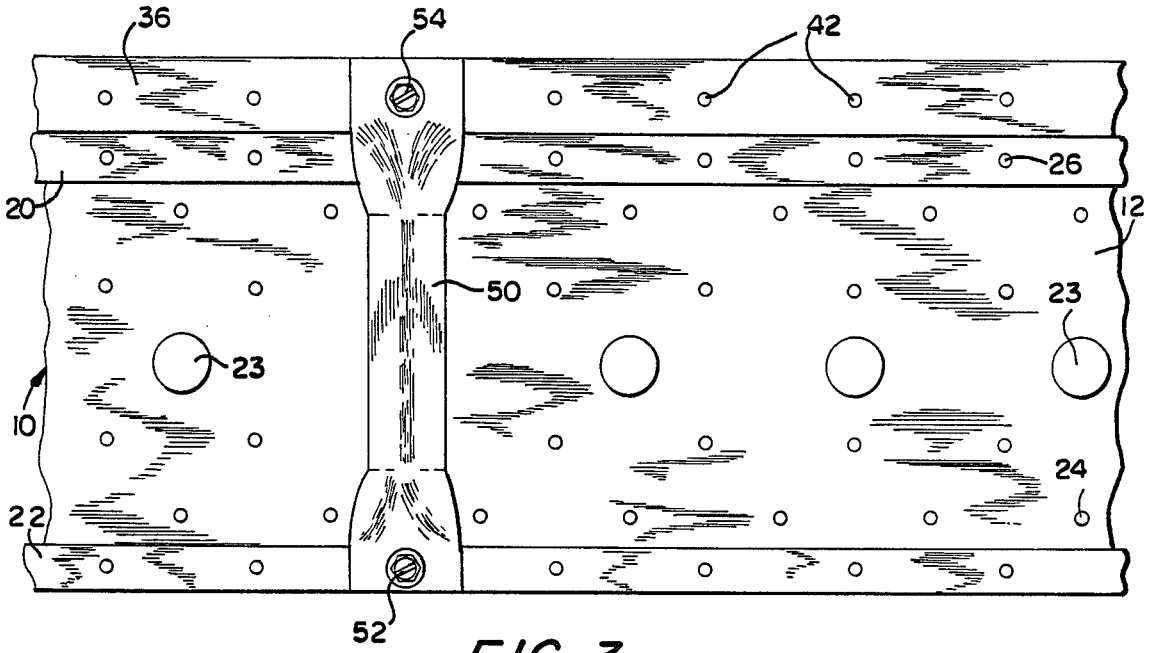
FIG. 3 is a side elevation as indicated by the arrow in FIG. 1.
Figure 4:
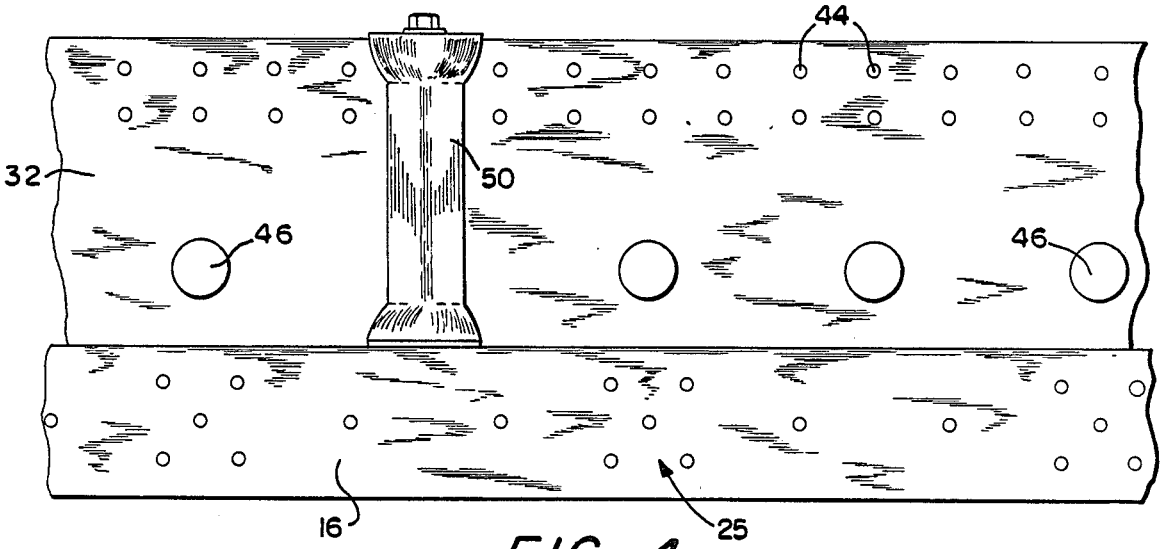
FIG. 4 is a bottom view as indicated by the arrow in FIG. 1.
Figure 5:
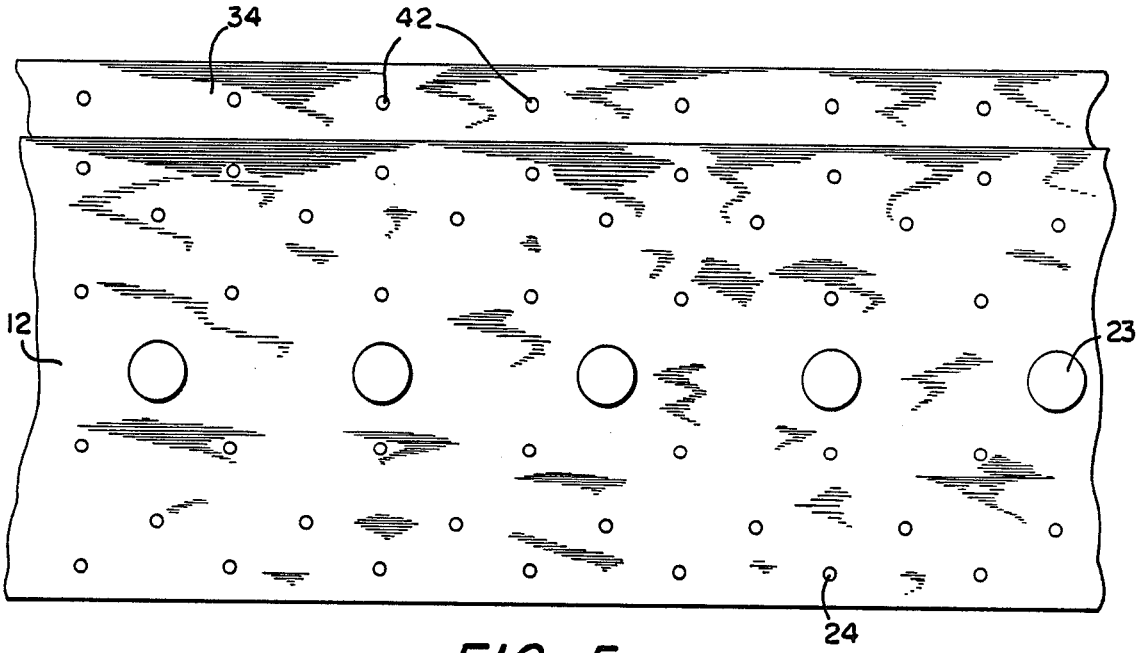
FIG. 5 is a side elevation as indicated by the arrow in FIG. 1.
Figure 6:
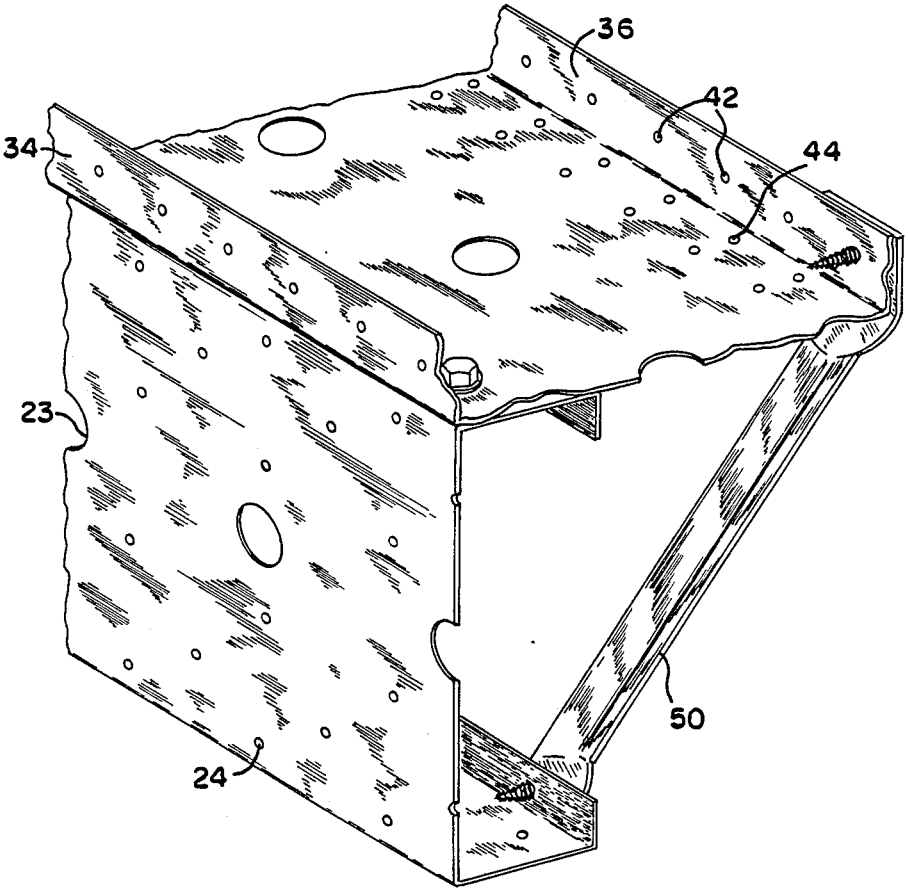
FIG. 6 is a perspective view of a footing frame according to the present invention.

The method for constructing a building structure according to this invention begins with site preparation. This is accomplished by means known in the art and generally includes clearing the site and grading it to a smooth and level surface. Earth can then be removed to form a mold for the footing and the slab. A footing frame is then erected at the site or brought to the site. The footing frame can be constructed in widely different styles and embodiments. The footing frame should generally have a form portion which defines part of the mold into which the footing material is poured. The footing frame would also preferably have structure for facilitating the attachment of additional building structure to the footing frame. The footing frame may also include bracing structure to help support the weight of the additional building structure and to anchor the footing frame into the footing when it has cured.

The footing frame, when erected, should preferably be leveled. This can be accomplished by means known in the art. Examples would include simple structure such as concrete blocks, wood shims and other similar materials, or simply earth packed underneath the frame to shore up the space beneath the footing frame. The footing frame would be tested for level using level testing instruments known in the art, after which material could be added or removed from beneath the footing frame as required. More elaborate mechanisms have been designed specifically for effecting the leveling process. One such mechanism that is particularly well suited for practice of the invention is the leveler described in co-pending application Ser. No. 723,282, filed Apr. 15, 1985 now U.S. Pat. No. 4,569,169, the teachings of which are hereby fully incorporated by reference.

After the footing frame is erected and leveled, additional building structure may be attached to it. The building structure can be substantially the entire framework of the structure. It is possible to substantially complete an entire building structure with this method prior to pouring the footing. That is, such interior features as wall panels and ceilings and exterior features such as siding and roofing can be substantially completed before laying the footing. The flooring may also be substantially completed prior to completion of the footing although it is preferable to erect the foor, or in multiple store structures the bottom floor, afterwards so that it does not interfere with pouring the footing. Alternatively, the footing may be poured after the footing frame has been erected and leveled, but prior to further construction of the building. This differs from conventional techniques, as the footing frame becomes a permanent part of the building, to which further structure is attached.

The footing is poured into the frame by techniques and instrumentalities that are consistent with current practices, although it is foreseeable that alternative means could also be used. The footing is constructed of materials known in the art for this purpose which of course would include concrete.

In some building construction systems which produce structures with high strength and integrity, it may be possible to attach building structure to the footing frame prior to placement on site. A building structure complete with footing frame could be constructed at a location remote from the site. The structure could then be moved or airlifted to the site after which any necessary additional building structure could be attached and the footing poured. This technique would facilitate the construction of a building structure under adverse conditions as in military settings and where such factors as time, location and weather do not permit standard construction techniques.

The method of the invention is well suited for modular building constructions, especially those set forth in co-pending applications: Ser. No. 496,960, filed May 23, 1983 now U.S. Pat. No. 4,551,957; Ser. No. PCT/US 84/00782, filed May 22, 1984; Ser. No. 678,505, filed Dec. 5, 1984; Ser. No. 678,507, filed Dec. 5, 1984 now abandoned; Ser. No. 678,508, filed Dec. 5, 1984 now abandoned; Ser. No. 709,317, filed Jan. 22, 1985 now U.S. Pat. No. 4,697,393; Ser. No. 723,282, filed Apr. 15, 1985 now U.S. Pat. No. 4,569,169; and Ser. No. 723,349, filed Apr. 15, 1985 now abandoned; the disclosures of all of which are hereby incorporated fully by reference. The co-pending applications disclose different aspects of novel methods and apparatus for constructing a building structure using a series of pre-engineered components which can be interconnected on site in innumerable ways to form an integral building structure, without the need for complete prefabrication according to any particular design. These structures show high integrity without the presence of a footing.

The various components and methods of Applicant's systems are widely yet precisely adaptable such that an unlimited number of building designs may be constructed quickly and inexpensively from the few basic types of components. Applicant's systems include prefabricated sets of interconnectable girder members, connecting plate members and attachment members for selectively securing the girder and plate members to one another. The girder members are prefabricated in a plurality of incrementally different lengths and have flanges forming channel-shaped cross-sections of uniform web width. Each of the plate members is formed with flanges to form at least two receiving channels of uniform web width and cross-section. The respective web widths of each end of each girder and each receiving channel are dimensioned to enable portions of each to nest snuggly one inside the other. Primary loads are borne by and transmitted between the girder and plate members in planes defined by the nested webs. The flanges of the girder members and plate members bear against one another to provide high rotational rigidity and overall frame stiffness. The set of attachment members is insertable through apertures in and engageable with nested portions of both the girder and plate members to provide full surface engagement of the nested web portions. The girder members are provided with a lattice of precisely positioned apertures and patterns of apertures such that components can be variously interconnected without the necessity of drilling holes. In this manner a plurality of frame structures for buildings, of varied size and shape, may be easily constructed from sets of prefabricated girder members, prefabricated plate members, and other components secured together by a set of standard attachment members.

A footing frame apparatus that is particularly well suited for use in the method of this invention is shown in FIGS. 1–6. The footing frame includes a form portion 10 which is preferably a channel member of squared-off C-shaped cross section with a web 12, flange 14 and 16, and inturned or inwardly directed lip portions 20 and 22. The form portion channel member 10 is preferably the same kind of member used to form the studs, headers and joists in the building structure such that the number of different components necessary to form a building structure is kept to a minimum. The form portion channel member 10 would preferably have a lattice work including apertures 24 formed therein to receive screws 29 or other structure. This channel member would preferably be that described in co-pending U.S. application titled "Structural Component", Ser. No. 797,029, filed herewith on Nov. 12, 1985, the teachings of which are hereby fully incorporated by reference.

Longitudinally spaced large diameter apertures 23 are provided at the center of the web portion 12. A plurality of small diameter apertures 24 are also provided in the web portion 12. A repeating pattern of apertures is provided in each flange portion including a five-apertured pattern designated herein as a pentad 25, with an aperture at each corner of an imaginary square and an aperture at the center of the square. A plurality of apertures 26 are also provided in the inwardly directed lips 20, 22, preferably forming a longitudinal row on each lip.

The pattern of apertures 24 is designed to give great versatility in the alignment and placement of apertures for suitable fastening means or for other purposes regardless of the position or use of the component. A minimum of holes therefore must be drilled during the construction process. If the structure is properly designed and installed, no holes may have to be drilled. The footing material is very viscous when poured and there is no problem caused by seepage of the material through the lattice work of apertures. What little seepage occurs only serves to further lock the footing frame to the footing.

Structure for the attachment of additional building structure, including studs, to the form portion 10 is preferably provided as a stud track member 30. The stud track member 30 is affixed to the top leg 14 of the form portion channel member 10 by suitable means such as screws 29. The stud track member 30 comprises a web portion 32 and two flanges 34, 36 perpendicular to the web 32 and forming an upwardly opening U-shaped channel. The stud track member 30 preferably has a pattern of apertures which provide great versatility in the possible alignments with apertures in other components, particularly apertures in components such as the form portion channel member 10. The aperture include a set of spaced apertures 42 on each lateral flange of the stud track 30, apertures 44 arranged preferably in one longitudinal row down each lateral side of the web 32 and larger diameter apertures 46 spaced longitudinally down the center of the web 32.

Additionally support structure such as brace member 50 is joined at one end to the inwardly directed flange 22 of the channel member 10 by suitable means such as screw 52. The opposite end of the brace 50 is joined to the perpendicular flange 36 of the stud track 30 by suitable means such as screw 54. The bracing structure helps to give the footing frame assembly high strength and rigidity to provide a better support for the building structure as it is assembled on the footing frame and additionally serves to anchor the footing frame in the footing when it cures. The additional brace member 50 may be designed in V-shape as shown for additional strength.

The footing frame of the invention can be quickly and easily assembled on site in innumerable sizes and designs. These would include multistory constructions as set forth in co-pending U.S. patent application titled "Construction System", Ser. No. 797,028 filed herewith on Nov. 12, 1985 now U.S. Pat. No. 4,688,358, the contents of which are hereby fully incorporated by reference. The provision of apertures in the components is such that aligned pairs of apertures in adjacent components are almost always present to receive suitable fastening means such as screws and the like. The footing frame of the invention can then be assembled on site rapidly with just a screwdriver or its equivalent.

Figure 7:
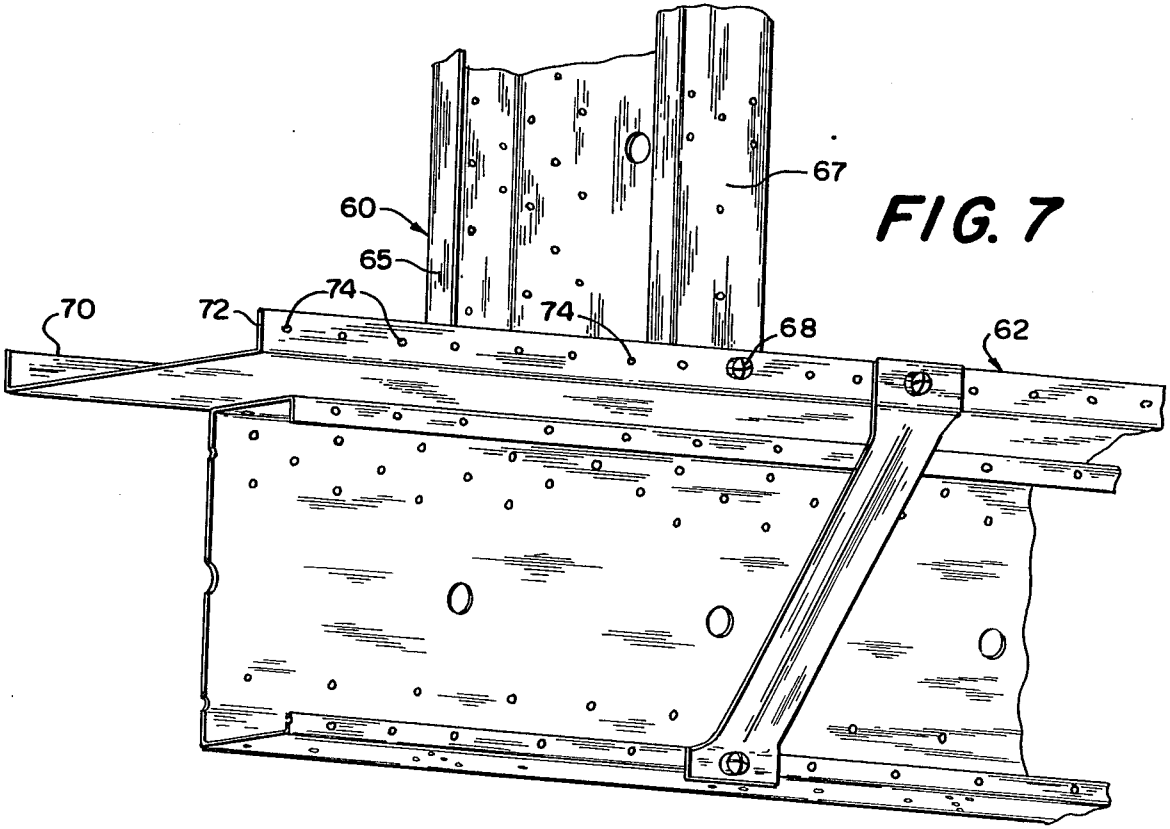
FIG. 7 is a perspective view of a footing frame according to the present invention with additional wall structure.

Additional building structure can be rapidly attached to the footing frame assembly. The manner in which girder members, when used as wall studs, would be connected to the stud track member 30 of the footing frame is shown in FIG. 7. The wall stud 60, preferably a channel member such as the form portion 10, is set on end in the stud track member 62 with the flange portions 65, 67 of the stud 60 abutting the flanges 70, 72 of the stud track member 62. Apertures in the flange portion 67 of the wall stud 60 are aligned with the apertures 42 in the stud track member 62 to allow passage of suitable fastening means such as screws 68. In this manner, the wall studs may be quickly erected onto the footing frame by simply aligning the apertures and fixing the fastening means in place.

The wall studs for the building structure may be attached to the footing frame by the method and apparatus of the invention in a fraction of the time which would be required to erect the frame using conventional techniques. Forms do not have to be erected and then taken down after the footing has been poured since the footing frame becomes set in the concrete or other footing material and thus an integral part of the building structure. The method of the invention provides a significant improvement in the anchoring of the building structure which results from the footing frame becoming set in and integral with the footing. It is also not necessary to wait until the footing has cured to begin building the structure. Rather, some or all of the structure is built first in the method and apparatus of the invention and only then is the footing poured. In this manner, work crews may proceed to the next site without having to go back and forth between sites when the foundations cure. It would also be possible to erect a structure remote from its final resting site and then simply install the building by leveling it and pouring the footing into the footing frame. Such a system can be advantageous where adverse conditions or time restraints preclude erection of the structure on the site.

Figure 8:
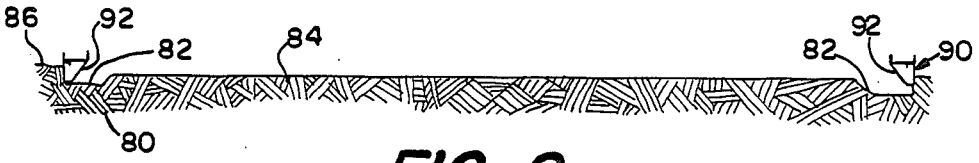
FIG. 8 is a cross sectional view of a building site at a first stage of construction according to the invention.
Figure 9:
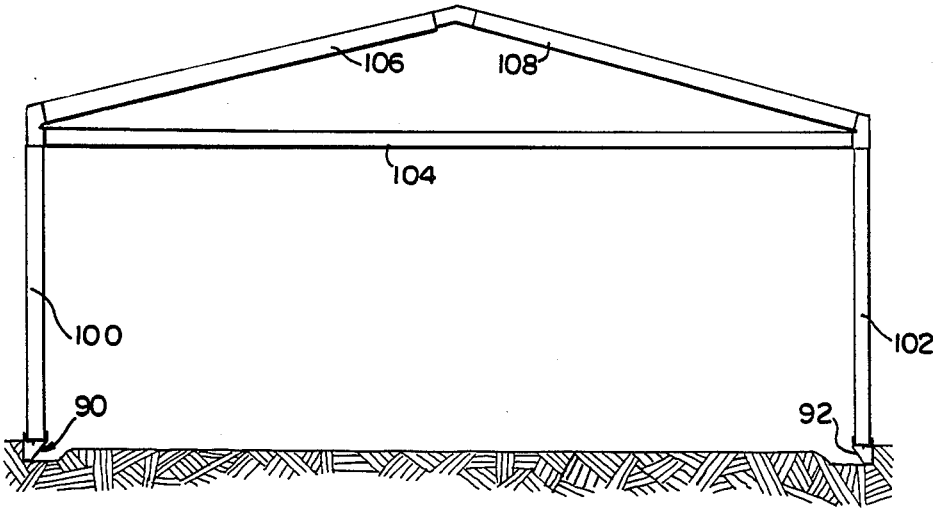
FIG. 9 is a cross sectional view of a building site at a second stage of construction according to the invention.
Figure 10:
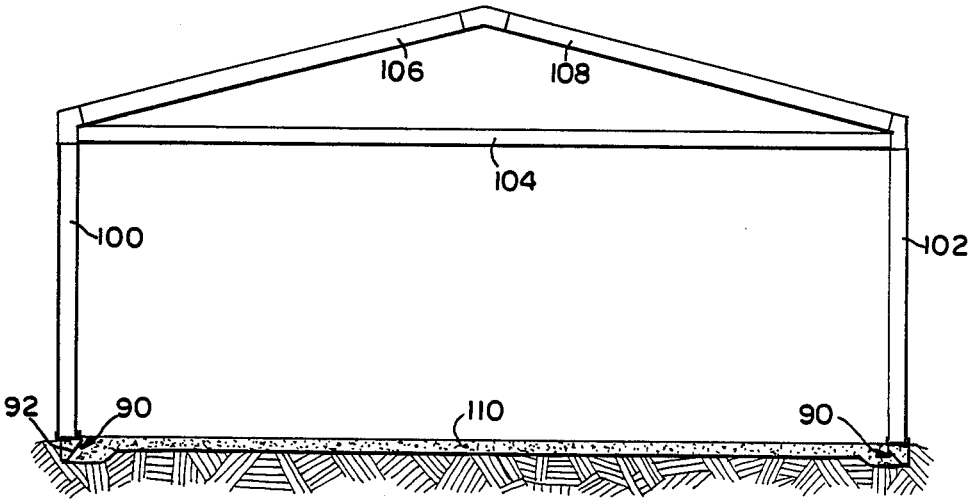
FIG. 10 is a cross sectional view of a building site at a third stage of construction according to the invention.

A manner in which the footing frame apparatus may be used in conjunction with the method of the invention is depicted in FIGS. 8–10. FIG. 8 is a cross sectional view through a site showing ground 80 which has been prepared to mold the footing by digging out a peripheral trench 82 and a relatively higher raised interior surface 84 for the slab, both of which, however, are lower than the surrounding ground level 86. The footing frame 90 is positioned in the trench 82 with the form portion against the surrounding ground and the bracing portions 92 extending inward. If it were desired to extend the level of the footing above ground level, the footing frame could be elevated in the trench, even by temporary structure. As a further alternative, the footing frame could be dimensioned slightly larger than the trench and rest just outside the trench boundary (or the trench dimensioned slightly smaller than the footing frame). FIG. 9 shows additional building structure which has been attached to the frame 90, including studs 100, 102 and truss members 104, 106 and 108. It should be understood that as much or as little additional building structure may be connected to the footing frame 90 as desired before pouring the footing. The footing frame 90 should, however, be leveled prior to pouring the footing. This can be accomplished either before or after additional structure has been connected to the footing frame 90. Leveling is easily accomplished by using wood shims or the like, or by packing earth underneath the footing frame. After the desired additional building structure has been connected to the footing frame, the footing may be poured according to conventional techniques. The finished footing is shown in FIG. 10. The footing 110 is seen to firmly engage the footing frame 90 such that the frame becomes firmly interconnected with and to the footing 110 and thus the building structure becomes firmly tied to the footing 110.

The materials which are used in constructing the footing frame of the invention would include any variety of materials which are applicable to the building construction setting, that is, the materials should have high strength and longevity. Examples of suitable materials would include galvanized or painted steel. It would be apparent to one skilled in the art that other materials might however perform as well or better, particularly new synthetic materials which are finding wide application in the building construction industry.

This invention may be embodied in other forms without departing from the spirit or essential attributes thereof, and accordingly, reference should be made to the appended claims, rather than the foregoing specification, as indicating the scope of the invention.

I claim:

1. A method for constructing a building on a site, comprising the steps of:

erecting a footing frame;

attaching further building structure to the footing frame; and constructing a footing for the building by pouring a fluid footing mixture interiorly of and adjacent the footing frame after attachment of the further building structure thereto, the footing frame containing the mixture until hardened, whereby the footing and the footing frame are integral with one another.

2. The method of claim 1, further comprising the step of leveling the footing frame prior to attaching the further building structure to the footing frame.

3. The method of claim 1, further comprising the step of leveling the footing frame after the further building structure has been attached to the footing frame.

4. The method of claim 2 or 3, further comprising the step of grading and excavating the site prior to the step of erecting the footing frame.

5. The method of claims 2 or 3, wherein the step of erecting the footing frame comprises the step of affixing a stud track means to a form means.

6. The method of claim 5, wherein the step of erecting the footing frame further comprises the step of affixing bracing structure to at least one of the form means and the stud track means with fastening means.

7. The method of claim 6, wherein the step of attaching the further building structure to the footing frame includes the step of affixing a plurality of wall studs to the stud track means.

8. The method of claim 6, wherein the step of affixing a plurality of wall studs to the stud track means includes the step of aligning apertures on the wall studs with apertures in the stud track means to receive the fastening means.

9. The method of claim 1, comprising the step of filling the interior of the footing frame with the footing mixture to form an integral slab floor.

10. The method of claim 1, wherein the footing frame comprises a channel member of substantially squared-off C-shaped cross section.

11. The method of claim 5, wherein the stud track means comprises an upwardly opening channel member of substantially U-shaped cross section adapted to receive the ends of the plurality of wall studs.

12. The method of claim 10, wherein each of the channel members of the footing frame and the stud track means are provided with a plurality of apertures, apertures on the footing frame being alignable with apertures on the stud track means to receive standardized fastening means, and apertures in the stud track means being alignable with apertures in the wall studs to receive the standardized fastening means.

13. A construction system for erecting buildings, comprising:

a footing frame comprising form means and means for attaching additional building structure to the footing frame without the need for a footing;

a plurality of wall studs, the wall studs being affixed to the means for attaching additional building structure to the footing frame the footing frame and the additional building structure affixed thereto being self-supporting and levelable prior to pouring a footing; and, a footing poured interiorly of the footing frame and hardened in place, the form means of the footing becoming set in and integral with the footing.

14. The construction system of claim 13, wherein the means for attaching the wall studs and additional building structure to the footing frame comprises stud track means with an upwardly opening channel member of C-shaped cross section affixed to the form means.

15. The construction system of claim 14, wherein the wall studs comprise channel members having substantially squared-off C-shaped cross sections, the stud track means being adapted to receive an end of the wall studs.

16. The construction system of claim 15, wherein each of the form means and the stud track means are provided with a plurality of apertures, apertures on the form means aligning with apertures on the stud track means to receive fastening means, and apertures on the stud track means aligning with apertures in the wall studs to receive fastening means.

17. The construction system of claim 16, further comprising brace means.

18. The construction system of claim 17, wherein the brace means comprises a strut connected between the form means and the stud track means.

19. A method for constructing a building on a site, comprising the steps of:

preparing a channel on the site to receive a poured footing;

erecting a permanent footing frame in the channel adapted to support further building structure;

leveling the footing frame;

pouring a curable fluid footing mixture into the channel, at least interiorly of the footing frame, the footing frame becoming at least partially embedded in the footing; and, after the footing has cured, completing construction of the building.

20. The method of claim 19, comprising the step of filling the interior of the footing frame with the footing mixture to form an integral slab floor.

* * * * *